United States Patent [19]

Bakermans et al.

[11] Patent Number: 4,821,556

[45] Date of Patent: Apr. 18, 1989

[54] STAMPING AND FORMING MACHINE HAVING IMPROVED PILOT PINS

[75] Inventors: Johannes C. W. Bakermans, Harrisburg; John R. Studer, Hummelstown, both of Pa.

[73] Assignee: AMP Incorporated, Harrisburg, Pa.

[21] Appl. No.: 184,238

[22] Filed: Apr. 21, 1988

[51] Int. Cl.[4] ..... B21D 28/04

[52] U.S. Cl. ..... 72/420; 72/335; 72/361; 226/57

[58] Field of Search ..... 72/335, 336, 361, 419, 72/420, 421; 83/202, 282, 385, 418, 454; 226/57, 67

[56] References Cited

U.S. PATENT DOCUMENTS

| | | | |
|---|---|---|---|
| 2,818,923 | 1/1958 | Di Pascuale et al. | 83/282 |
| 3,338,084 | 8/1967 | Stegman, Sr. | 72/335 |
| 3,587,502 | 6/1971 | Murray . | |
| 3,707,932 | 1/1973 | Murray . | |
| 3,900,257 | 8/1975 | Woolley, Jr. et al. | 226/57 |
| 4,489,871 | 12/1984 | Bakermans et al. . | |
| 4,497,196 | 2/1985 | Bakermans et al. . | |

*Primary Examiner*—Lowell A. Larson

*Attorney, Agent, or Firm*—Fritz L. Raring; Bruce J. Wolstoncroft

[57] ABSTRACT

Stamping and forming machine has first and second tooling assemblies which are movable relatively towards and away from each other. Pilot pins are mounted on, and moved with, the first tooling assembly. The pilot pins enter pilot holes in the strip material and are movable on the first tooling assembly between extended positions and retracted positions. When the tooling assemblies are in their open, or separated, positions, the pilot pins are in their retracted positions and clearance is provided to permit feeding of the strip between the two tooling assemblies. As the tooling assemblies move to their closed positions, the pilot pins move to their extended positions and perform their piloting function. The pilot pins are actuated by an actuator which is separate from the actuator which moves the tooling assemblies.

16 Claims, 10 Drawing Sheets

STAMPING AND FORMING MACHINE HAVING IMPROVED PILOT PINSFIELD OF THE INVENTION

This invention relates to sheet metal stamping and forming machines and particularly to improved pilot pins for such machines.

BACKGROUND OF THE INVENTION

A conventional stamping and forming machine comprises a press having a fixed platen and a reciprocable ram which is movable towards and away from the platen. The tooling for performing operations on the strip material which is fed through the press is mounted on a die assembly comprising a lower or fixed die shoe, which is supported on the platen, and a movable or upper die shoe which is reciprocable with the ram. The upper and lower tooling is mounted on the upper and lower die shoes respectively. The tooling might, for example, comprise punches or forming tools on the upper die shoe and dies or other lower tooling on the fixed lower die shoe.

It is common practice to provide pilot pins fixed to the upper movable die shoe which have free ends that are located beyond the ends of the tooling, such as punches or forming tools, which are also mounted on the upper die shoe. During an operating cycle, as the upper die shoe moves towards the lower die shoe, the free ends of the pilot pins enter pilot holes in the strip material and precisely align the strip prior to engagement of the forming tools with the strip material. It is necessary to provide a fairly long stroke in conventional stamping and forming machines in order that the free ends of the pilot pins will be moved away from the lower or fixed tooling a distance sufficient to permit feeding of the strip when the upper or movable tooling is at its maximum distance from the fixed tooling; if the free ends are close to the fixed tooling, there may not be sufficient clearance to move the strip or feed it during the intervals between forming operations.

U.S. Pat. No. 4,497,196 (which is hereby incorporated by reference in its entirety) describes a stamping and forming machine which comprises a plurality of individual modules, each of which has two tooling assemblies therein which are in opposed confronting relationship. During each operating cycle, the tooling assemblies are moved towards and away from each other so that forming tools carried by the tooling assemblies will engage the strip and perform operations thereon. An important feature of machines of the type shown in the above-identified U.S. patent is that the combined strokes of the two tooling assemblies is very short as compared with conventional stamping and forming machines. A number of advantages are achieved by virtue of the short stroke of such machines, among which are: reduced noise levels, reduced power requirements, compact size as compared with conventional machines, and the capability of producing stamped and formed parts which have a high degree of dimensional precision. The short stroke or movement of the tooling assemblies, however, gives rise to problems with regard to the provision of pilot pins. Because of the fact that the tooling assemblies travel only a short distance and are separated from each other by a short distance when they are at the limits of their strokes away from each other, there is only a limited amount of space between the forming tools carried by the tooling assemblies. It is impractical, if not impossible, to provide conventional pilot pins on machines of the type described in U.S. Pat. No. 4,497,196 for the reason that if the pilot pins projected beyond the free ends of the forming tools, the pilot pins would prevent feeding of the strip material between the two tooling assemblies. The present invention is directed to the achievement of an improved mounting and actuating system for pilot pins in a stamping and forming machine and to the provision of a pilot pin mounting and actuating system for stamping and forming machines of the type described in the above-identified U.S. patent.

THE INVENTION

The invention comprises apparatus for performing stamping and forming operations on strip material, the apparatus having first and second tooling assemblies which are in opposed confronting relationship and which are movable towards and away from each other between open and closed positions along a tooling assembly path of reciprocation. Tooling assembly actuating means are provided for moving the tooling assemblies between their open and closed positions. The tooling assemblies have leading ends which are proximate to each other when the tooling assemblies are in their closed positions and which are spaced apart when the tooling assemblies are in their open positions. Strip feeding means are provided for feeding the strip material along a strip feed path which extends transversely of the tooling assembly path of reciprocation whereby operations are performed on the strip material when the tooling assemblies are moved to their closed positions. The apparatus has pilot pin means which are movable with, and extend parallel to, the first tooling assembly. The pilot pins means has free end portions which enter pilot holes in the strip material prior to arrival of the first tooling assembly at its closed position thereby precisely to position the strip material between the tooling assemblies prior to engagement of the tooling assemblies with the strip. The apparatus is characterized in that the pilot pin means is movable relative to the first tooling assembly and parallel to the tooling assembly path of reciprocation between a retracted position and an extended position. The free end portions of the pilot pin means are proximate to the leading end of the first tooling assembly when the pilot pin means is in its retracted position and is located forwardly of, and beyond, the leading end of the first tooling assembly when the pilot pins means is in its extended position. Pilot pin actuating means are provided for moving the pilot pin means from its retracted position to its extended position during movement of the first tooling assembly from its open position to its closed position, and for moving the pilot pin means from its extended position to its retracted position during movement of the first tooling assembly from its closed position to its open position. By virtue of these features, when the first and second tooling positions are in their open positions, the space between the leading ends of the tooling assemblies is not obstructed by the free end portions of the pilot pin means.

The pilot pin actuating means may comprise at least one lever means which is pivotally mounted intermediate its ends on an intermediate pivot. The lever means has one end which is pivoted to the pilot pin means, the other end of the lever means being pivotally connected to a means for causing oscillation of the lever means about the intermediate pivot in synchronism with reciprocation of the tooling assembly thereby to cause movement of the pilot pin means between its retracted position and its extended position in synchronism with movement of the first tooling assembly between its open position and its closed position. The first tooling assembly may comprise a reciprocable ram and the intermediate pivot can then be on the ram of the first tooling assembly.

In accordance with further embodiments, static guide means are provided for guiding the ram along the tooling assembly path of reciprocation and the other end of the lever means is pivotally connected to the static guide means whereby movement of the ram along the tooling assembly path of reciprocation results in movement of the intermediate pivot along the path of reciprocation and the lever means is thereby oscillated. The pilot pins are thereby moved with the ram of the first tooling assembly and are also moved relative to the ram of the first tooling assembly between their extended positions and their retracted positions.

THE DRAWING FIGURES

Figure 5:
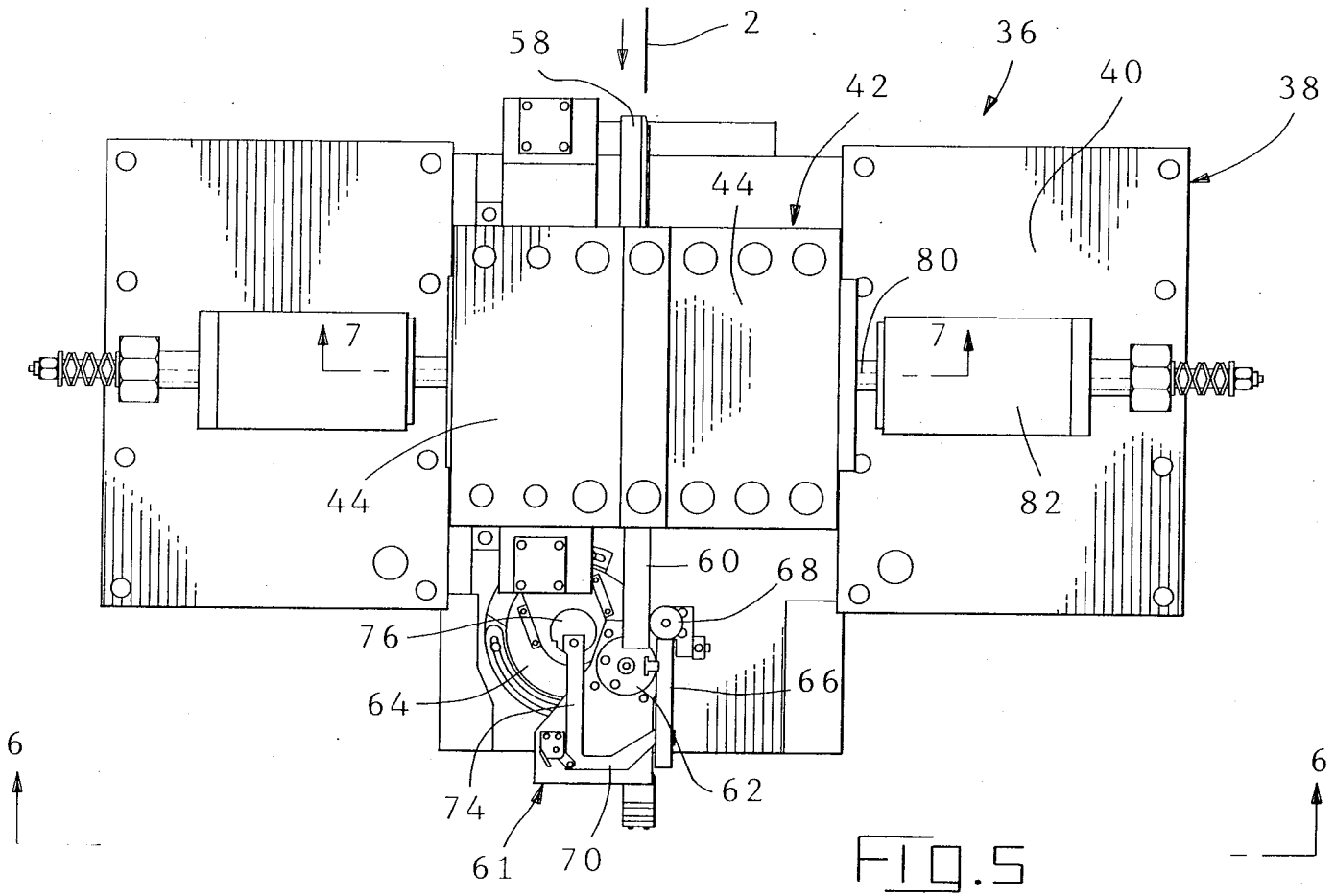
Figure 5:
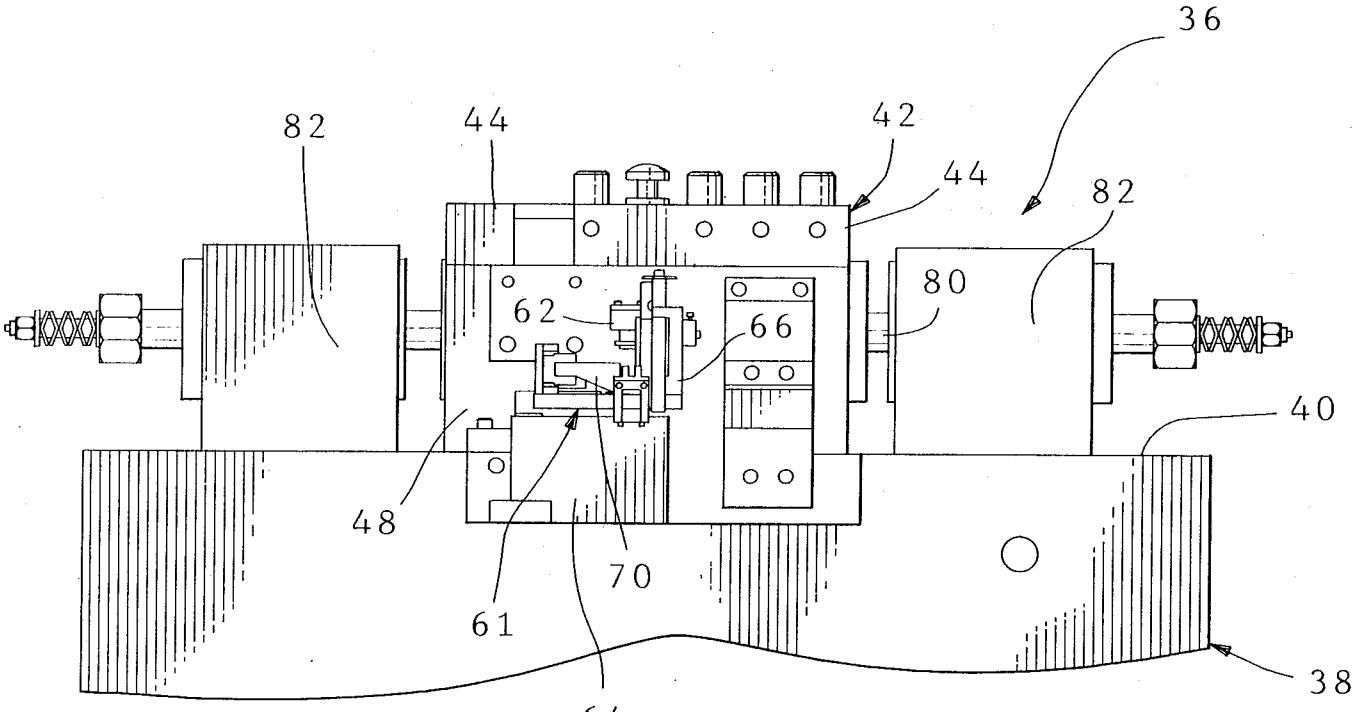

FIG. 5 is a top plan view of a single module of a stamping and forming machine of the type described in U.S. Pat. No. 4,497,196.

Figure 7:
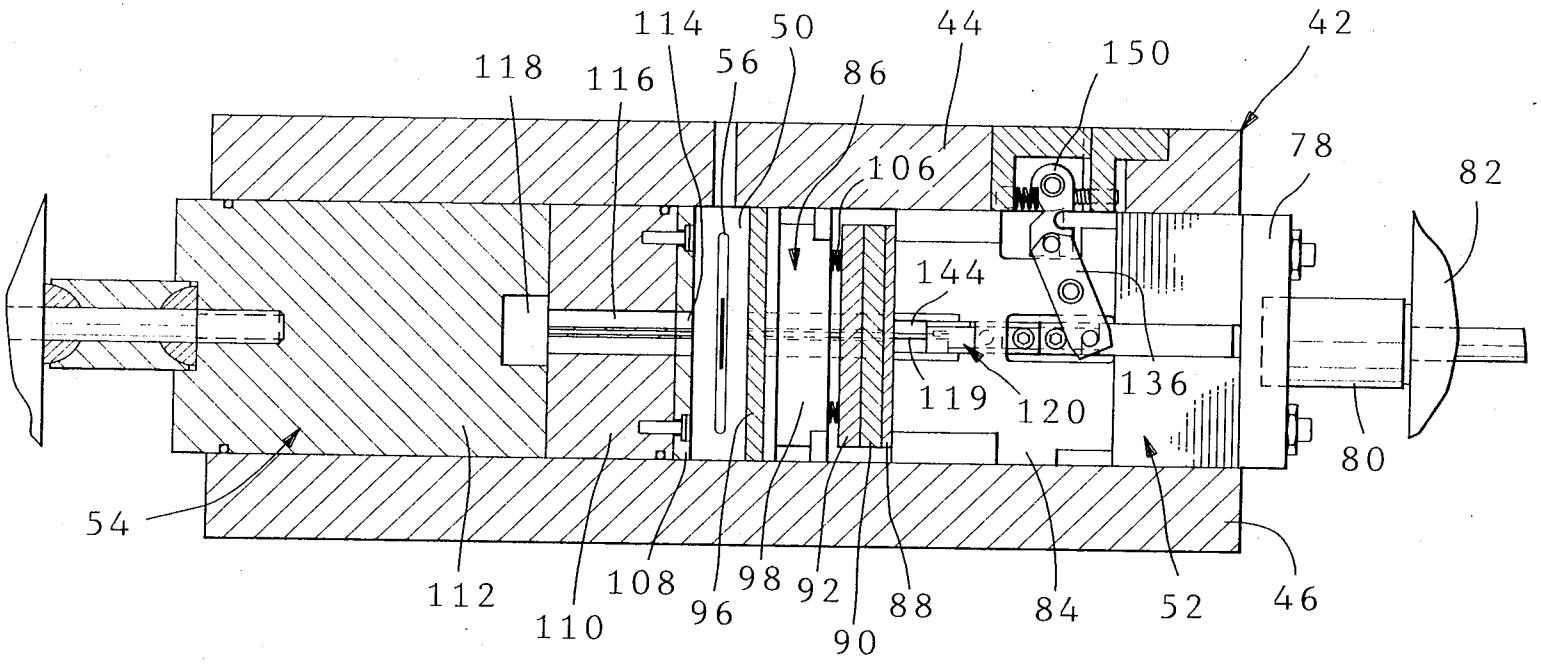

FIGS. 6 and 7 are views looking in the direction of the arrows 6—6 and 7—7 of FIG. 5.

Figure 8:
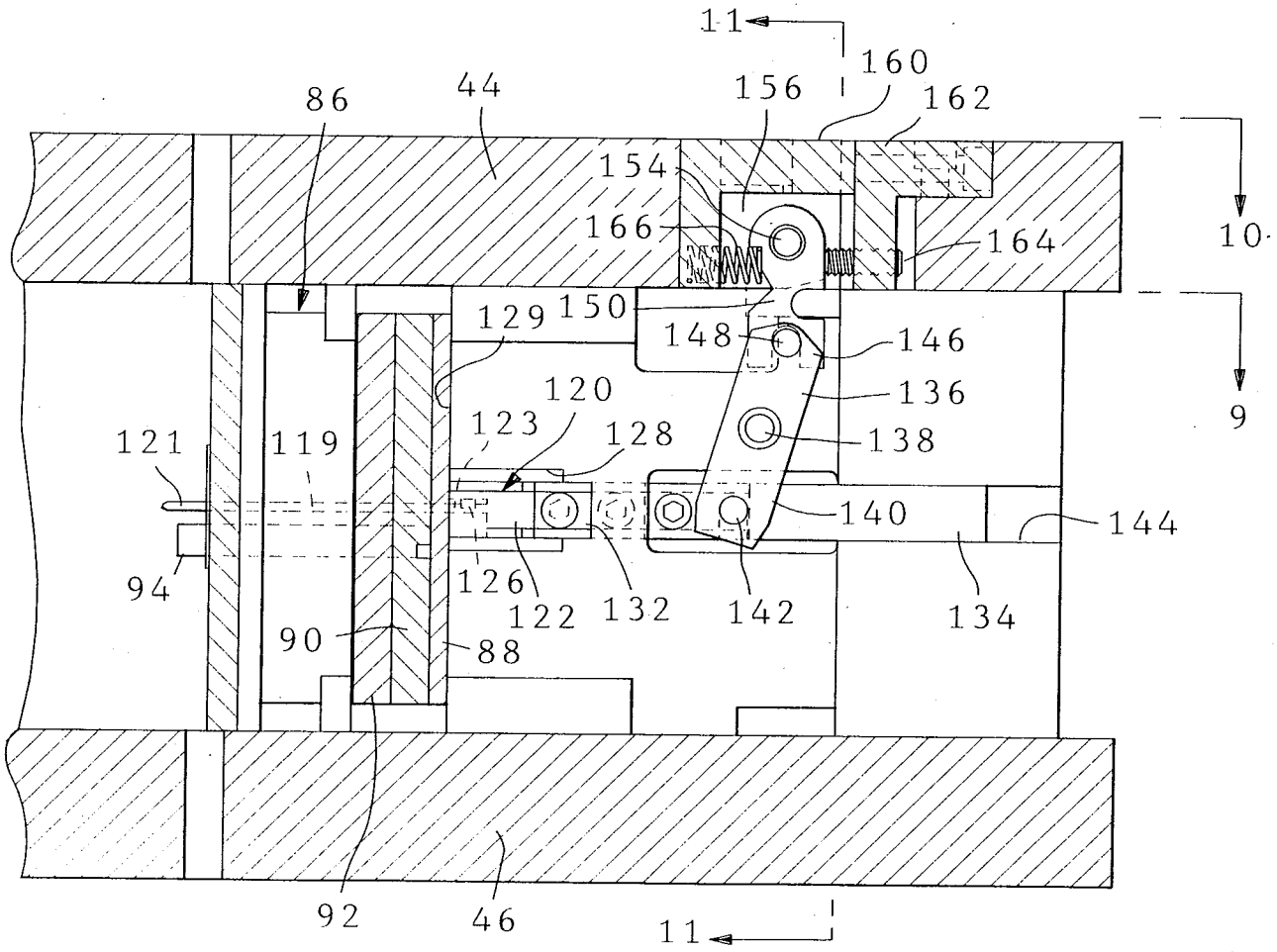

FIG. 8 is a fragmentary sectional side view, similar to FIG. 7, on an enlarged scale of the first tooling assembly showing the positions of the parts when the pilot pins are in their extended positions and the first tooling assembly is in its closed position.

Figure 9:
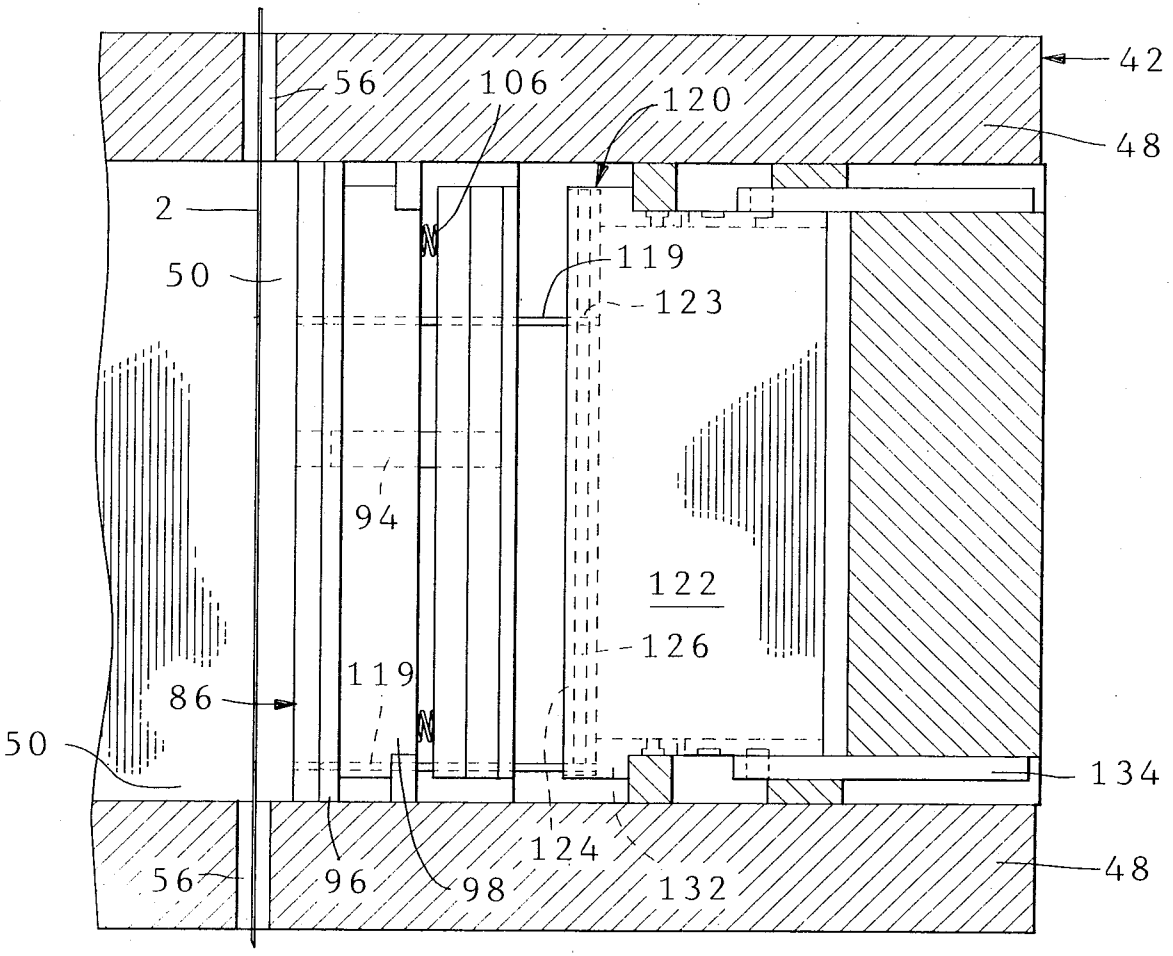
Figure 10:
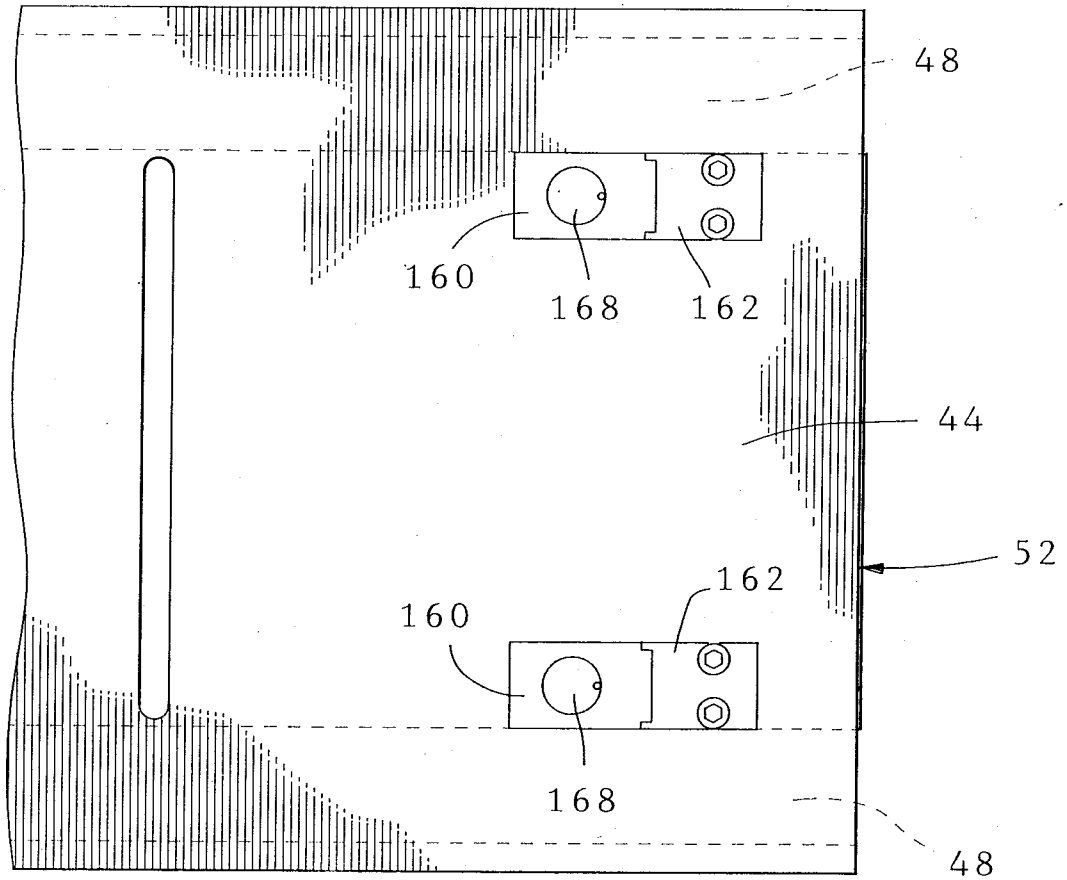
Figure 11:
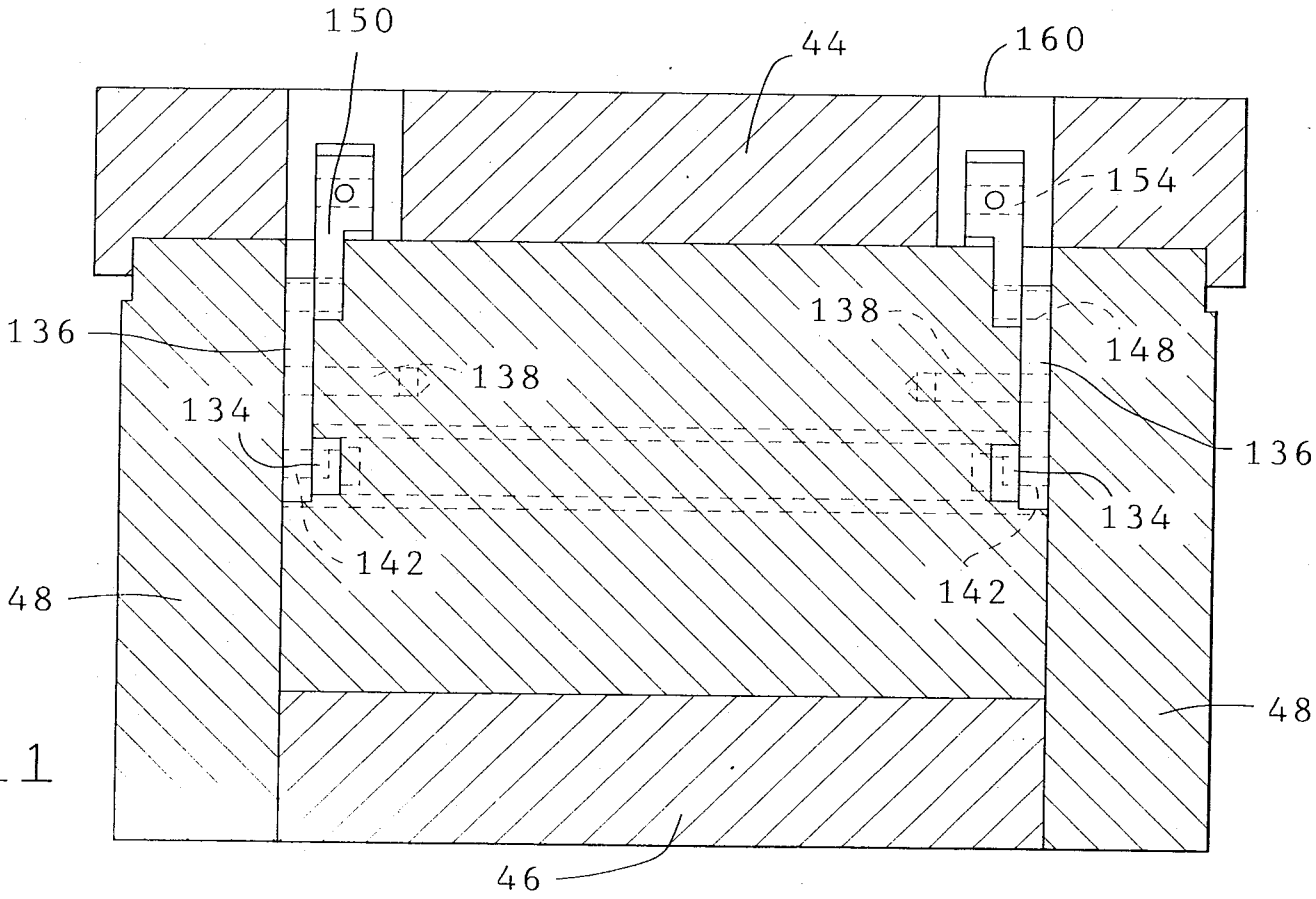

FIGS. 9, 10, and 11 are views looking in the direction of arrows 9—9, 10—10, and 11—11 of FIG. 8.

Figure 12:
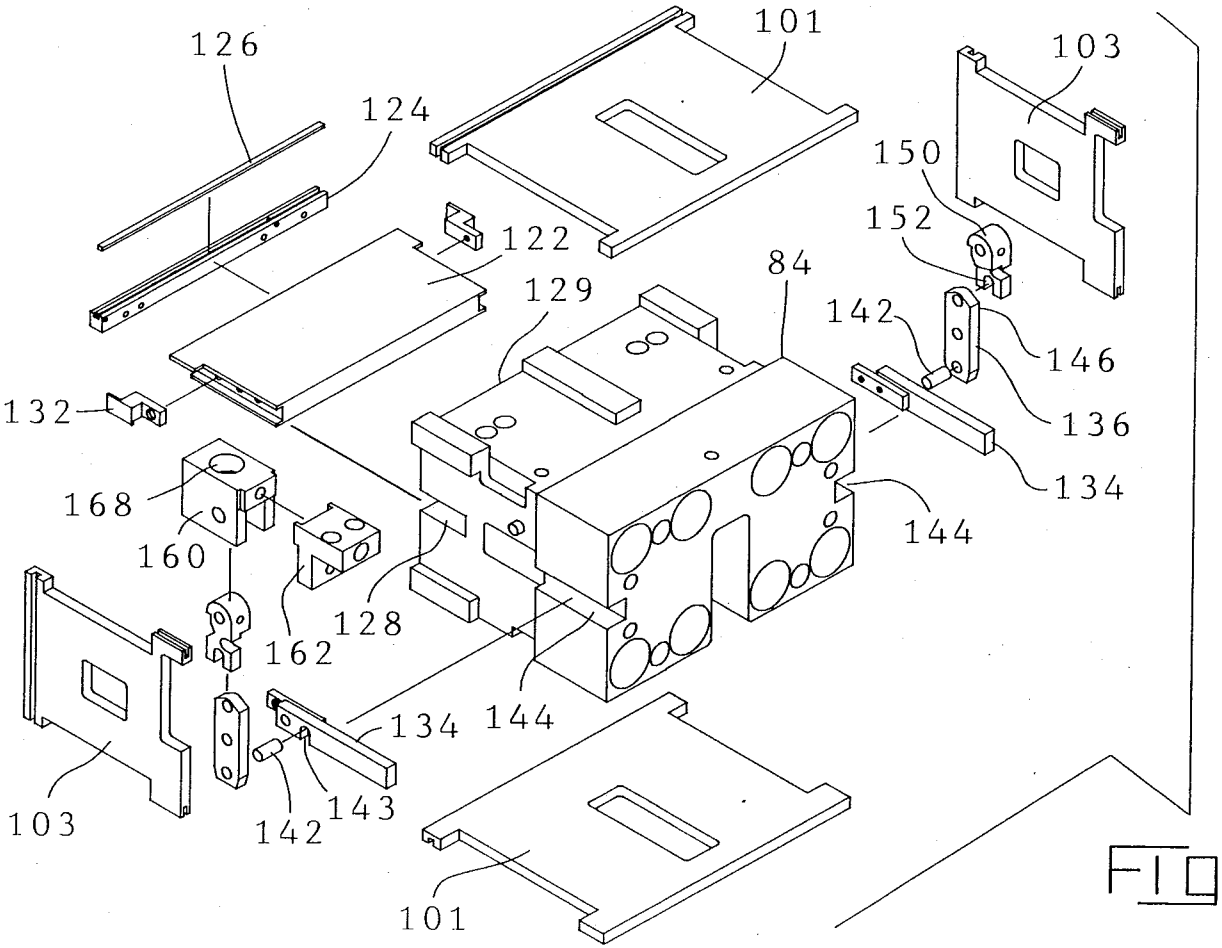

FIG. 12 is a perspective view of the first tooling assembly with the parts thereof exploded from the ram block.

THE DISCLOSED EMBODIMENT

Figure 1:
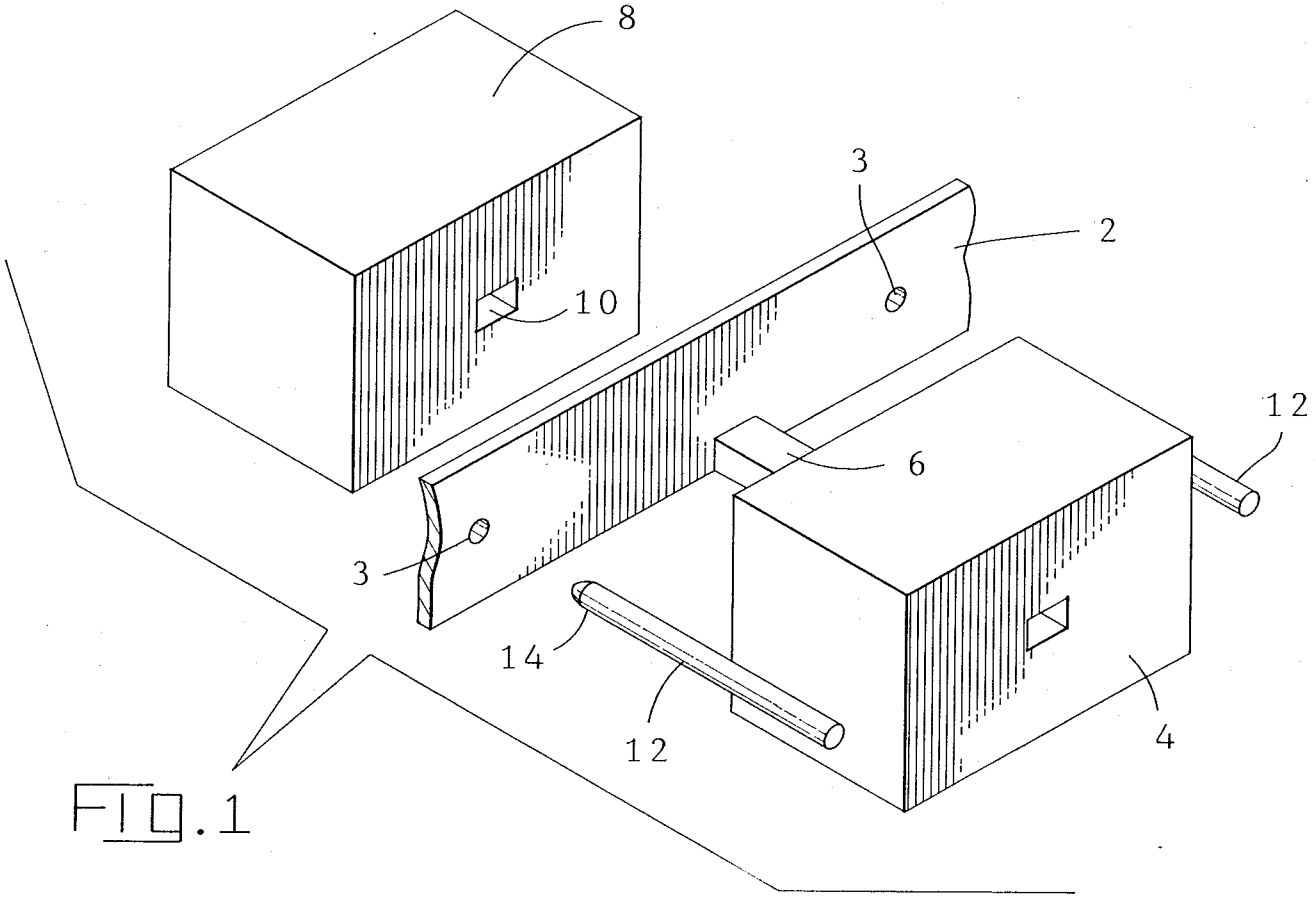
FIG. 1 is a diagrammatic perspective view which illustrates the function of pilot pins in a stamping and forming machine.

FIG. 1 illustrates the function of pilot pins in a stamping and forming machine. The machine has first and second tooling assemblies 4, 8 which are movable relatively towards and away from each other. The first tooling assembly 4 has a punch 6 mounted thereon, and the second tooling assembly has a die opening 10 so that when the tooling assemblies move against the surfaces of the strip 2, a hole will be punched in the strip. The pilot pins 12 are mounted on, or adjacent to, the first tooling assembly 4 and have free ends 14 which are located beyond the end of the punch 6. When the tooling assemblies move from their open position (shown in FIG. 1) to their closed positions, the pilot pins 12 enter previously punched pilot holes 3 in the strip and thereby precisely position the strip between the tooling assemblies. Pilot pins are required for precision stamping operations where a part, such as an electrical terminal, is formed in a series of stamping and forming steps. At each stage, the strip with the partially formed terminals thereon must be precisely positioned with respect to the tooling in order that precise dimensions in the finished product can be maintained.

It will be apparent from FIG. 1 that when the tooling assemblies 4, 8 are in their open positions, the ends 14 of the pilot pins must be spaced from the path along which the strip material 2 is fed so that the pilot pins will not interfere with the strip feeding operation. Conventional stamping and forming machines usually have a fairly long stroke and adequate clearance is provided for feeding of the strip even though the pilot pins are fixed to, or move with, the first tooling assembly 4. However, if the stroke, that is the movement of the tooling assemblies, is short, as in the machine shown in U.S. Pat. No. 4,497,196, the conventional method of mounting pilot pins illustrated in FIG. 1 is not satisfactory for the reason that if the pilot pins are made long enough to perform their piloting function, they will interfere with their strip feeding operation.

Figure 2:
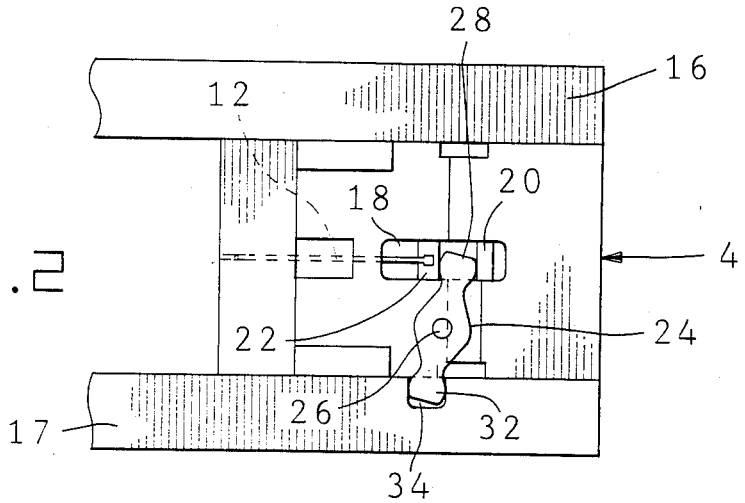
FIGS. 2–4 are sectional side views showing the first tooling assembly of a relatively simply embodiment of the invention and illustrating the movement of the pilot pins relative to the ram block of the tooling assembly during an operating cycle.
Figure 3:
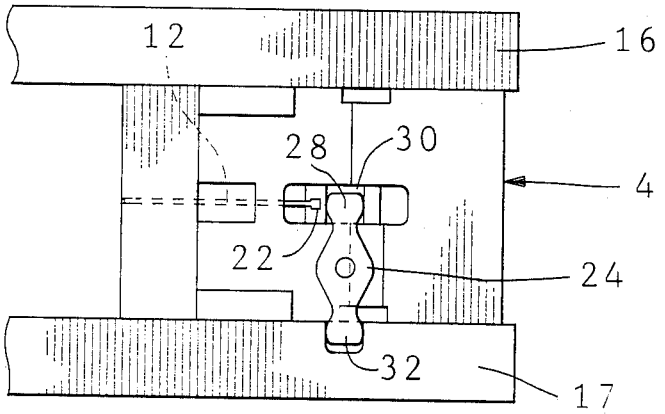
Figure 4:
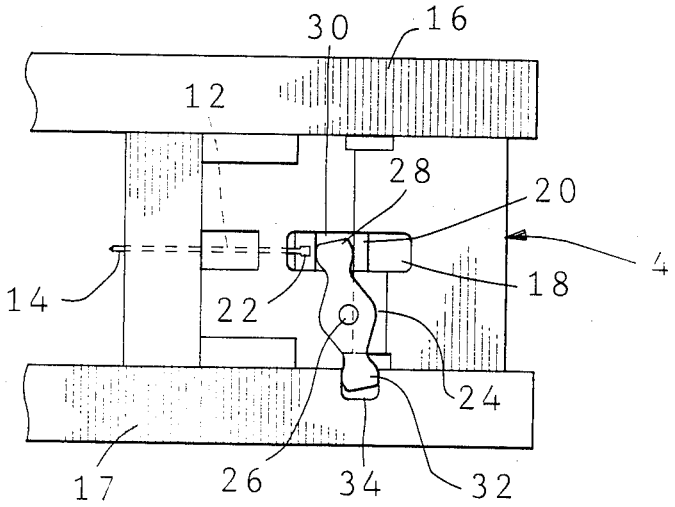

FIGS. 2–4 show a simplified, but fully operational, embodiment of the present invention. These views show only the first tooling assembly 4 which is contained and guided between static guide plates 16, 17. The pilot pins 12 have outer or free ends 14 which are recessed within the first tooling assembly 4 when the first tooling assembly is in its open position shown in FIG. 2. The inner ends 22 of the pilot pins are secured to a yoke or slide 20 which is slidably contained in an opening 18 which extends through the first tooling assembly 4. The pilot pins are moved from their retracted positions, FIG. 2, to their extended positions, FIG. 4, by an actuator which is separate from the actuator which reciprocates the tooling assembly 4. The pilot pin actuator comprises a lever 24 which is pivoted at 26 intermediate its ends to the first tooling assembly so that the lever moves with the first tooling assembly between the positions of FIGS. 2 and 4. One end 28 of the lever is pivotally connected to the slide yoke 20 in a loose pivotal connection. The end of the lever has rounded edges which are received in an opening 30 in the yoke. The other end 32 of the lever 24 is similarly pivoted in a recess 34 in the lower guide member 17. The loose pivotal connections at the ends 28, 32 of the lever permit these ends to move along an arcuate path while the intermediate pivot 26 moves along a straight line path.

FIG. 2 shows the positions of the parts when the first tooling assembly is in its open position and the slide is in its retracted position. As the tooling assembly 4 moves through the position of FIG. 3 to the position of FIG. 4, the lever 24 is swung through a counterclockwise arc by virtue of the fact that the lower end of the lever 32 has a fixed pivot and the intermediate pivot 26 moves along a straight line path. The upper end of the lever therefore moves the yoke 20 leftwardly relative to the tooling assembly 4 and the free ends of the pilot pins are thereby caused to move to its extended position. As shown in FIG. 4, the free ends are now located beyond the left hand end of the tooling assembly and can enter the pilot holes 3 in the strip. When the tooling assembly moves from the position of FIG. 4 to the position of FIG. 2, the pilot pins are retracted so that the strip can be fed for the next operating cycle.

FIGS. 2–4 show that the pilot pins move with he first tooling assembly 4 and also move relative to the first tooling assembly 4 by virtue of the fact that a separate actuator for the pilot pins is provided. FIGS. 5–12 show an embodiment of the invention which is incorporated into a stamping and forming machine of the type described in U.S. Pat. No. 4,497,196. Only those portions of the stamping and forming machine which must be described for an understanding of the present invention will be described below.

The machine module 36 comprises a module housing 38 having an upper surface 40 on which a tooling assembly housing 42 is mounted. The tooling assembly housing has a cover plate 44, a bottom plate 46 which is on the surface 40, and side plates 48 as shown in FIG. 9. These housing plates define a passageway 50 having a rectangular cross-section in which are contained the first and second tooling assemblies 52, 54. The side plates have slots 56 through which the strip material is fed and inlet and outlet guides 58, 60 which guide the strip along its feed path. The strip is fed by an intermittent strip feeding mechanism 61 comprising a feed sprocket 62 which is indexed during each feeding interval by a motor 64. The strip is held against the teeth of the sprocket during feeding intervals by a movable guide 66 which is pivoted at 68 so that it can be moved away from the sprocket during non-feeding intervals. Such movement of the guide 66 is accomplished by a bell crank having one arm 70 which has a slidable connection with the guide 66 and which has a second arm 74 which is pivoted to an eccentric 76. This feeding mechanism is described in greater detail in application Ser. No. 07/057,556, filed June 3, 1987. The first tooling assembly 52 has a backplate 78 thereon which is adjacent to the upper end 82 of an oscillating lever and is spaced from the lever end 82 by a spacer 80. The second tooling assembly 54 is similarly spaced from the upper end of an identical lever as shown. The manner in which these levers are oscillated is described fully in U.S. Pat. No. 4,497,196. The backplate 78, the lever 82 and spacer 80 are not shown in FIGS. 8–12 in the interest of simplicity and in view of the fact that these features are shown in FIG. 7.

The first tooling assembly 52 (FIGS. 7, 8, and 12) comprises a ram block 84 and a face plate assembly 86. The ram block has a spacer plate 88 on its left hand side as viewed in FIG. 7 and the tools in the form of punches 94 are held on the ram block by a tool holder plate 90, a retainer plate 92, and keys as shown which pass through notches in the punches 94. The face plate assembly 86 comprises a face plate 96 and a backup plate 98 which is secured to the face plate by fasteners. The punches extend through aligned openings in the face plate and the backup plate and their leading or free ends are recessed within the face plate when the first tooling assembly is in its open position. The face plate is movable between an extended position, in which it is spaced by a short distance from the retainer plate 92, to a retracted position in which it is against the retainer plate 92. The face plate assembly is normally biased to its extended position by springs 106 which are between the retainer plate 92 and the backup plate 98. The face plate assembly must move to its retracted position so that the outer or free ends of the punches will move relatively beyond the surface of the face plate and perform their punching function.

As described in application Ser. No. 07/074,656, filed July 17, 1987, top and bottom guide plates 101 and side guide or bearing plates 103 are interposed between the surface of the ram block and the internal surfaces of the passageway 50. These bearing and guide plates are secured to the face plate assembly and extend rightwardly as viewed in FIG. 7 over portions of the ram block. Their function is to guide the face plate and the ram block precisely during reciprocation of the tooling assembly.

The second tooling assembly 54 comprises a die plate 108, a die backup plate 110, and a ram block 112. The die plate 108 has die openings 114 therein in alignment with the punches and passageways 116 extend through the backup plate 110 to a recess 118 which extends transversely through the ram block 112. The scrap slugs which are produced in the punching operations are pushed through these passageways and into the transverse passageway 118. Disposal of the slugs can be accomplished by a belt disposal system as described in application Ser. No. 07/089,191, filed Aug. 25, 1987.

The pilot pins 119 have free ends 121 which are disposed within the face plate assembly when the first tooling assembly is in its retracted position as shown in FIG. 7. The inner ends 123 of the pilot pins are carried by a yoke assembly 120 which comprises a slide plate 122 of generally rectangular plate as shown in FIG. 9 having on its left hand end as viewed in FIG. 9, a pilot pin retainer or holder 124. The pilot pins have their inner ends 123 secured to this holder 124 by a key 126 and the holder and key are held on the slide 122 by keepers 132. The keepers in turn are secured to the sides of the slide by suitable fasteners. The slide or yoke 122 is slidably contained in a recess 128 which extends rightwardly as viewed in FIGS. 7 and 8 from the left hand surface 129 of the ram block 84.

As shown in FIGS. 8, 9, and 12, two spaced apart pilot pins are provided and the sides of the yoke slide 124 are coupled to two slide bars 134 by couplings which are fastened to the ends of the slide bars 134 and to the sides of the yoke slide 122. These slide bars 134 are precisely guided in suitable channels 144 and contribute to precise guidance of the pilot pins. In addition, the pilot pins extend through aligned openings in the tool holder plate 90, the retainer plate 92, and in the face plate assembly 86.

The actuator for reciprocating the yoke assembly 120 relative to the ram block comprises levers 136 which are pivoted at 138 intermediate their ends to the ram block. One end 140 of each lever has a pin 142 therein which extends into a slot 144 in the associated slide bar 134. The other end 146 of each lever has a pivot pin 148 therein which extends into a slot 152 in a pivot support arm 150. The arm projects into a suitable recess in the ram block and the bearing plates also provide clearance for this arm as shown in FIG. 12.

The pivot support arm 150 does not move during normal operation of the machine and the pivot 148 therefore serves as the nonmovable or fixed pivot for the lever 136 and corresponds to the pivotal connection 32, 34 in FIG. 2. However, the pivot support arm is itself pivotally mounted at 154 in a recess in a mounting block assembly 160, 162. The pivot support arm is biased in a counterclockwise direction by a spring 166 as viewed in FIG. 8 against an adjustable stop 164. The block 160 on which the pivot support arm is mounted is keyed to the block 162 which in turn is secured to the cover plate 44. The levers, pivot support arms, and slides 134 are mirror images of each other and are mounted adjacent to the housing slide plates as best shown in FIGS. 10 and 11. It is desirable to provide a well 168 in the upper portion of each block 160 and to provide absorbent material therein soaked with lubricating oil so that the mechanism will be continuously lubricated.

During normal operation of the machine, the actuator for the pilot pins 119 functions in the manner described above with reference to FIGS. 2–4. As the first tooling assembly ram block moves from its open position to its closed position, the intermediate pivot 138 moves with the ram block while the pivot 148 is stationary. The lever is thereby caused to oscillate and move the pilot pins from their retracted positions as shown in FIG. 7 to their extended position as shown in FIG. 8.

The pivot support arms 150 are in turn pivotally mounted in order to prevent damage to the pilot pins and their actuating means carried by the tooling assembly in the event of jamming or other malfunction. If, for any reason, the free ends of the pilot pins do not enter the pilot holes in the strip, or if no pilot holes are present in the strip, the biasing force of the springs 166 will be overcome during leftward movement of the first tooling assembly and the lever 146 will be carried leftwardly without oscillation, that is without arcuate movement about its intermediate pivot, during the remainder of the stroke of the machine. Damage to the pilot pins will thus be avoided since the pilot pins will simply move against the surface of the strip but will not be forced into the strip.

The principles of the invention can be used under a wide variety of circumstances other than those described above. Under some circumstances, only a single pilot pin may be used, and under other circumstances, it is possible that more than two pilot pins might be required at a single station in a progressive die. While the invention has been described with reference to a horizontal stamping and forming machine having both tooling assemblies movable towards and away from each other, the principles can be used also in a conventional stamping machine comprising a press having a platen and a press ram which is reciprocable towards and away from the platen. The use of the invention in a conventional stamping press will permit a substantial shortening of the stroke of the ram thereby effecting economies in the operation of the press.

We claim:

1. Apparatus for performing stamping and forming operations on strip material, the apparatus comprising first and second tooling assemblies which are movable towards and away from each other between open and closed positions along a tooling assembly path of reciprocation, tooling assembly actuating means for moving the tooling assemblies between their open and closed positions, the tooling assemblies having leading ends which are proximate to each other when the tooling assemblies are in their closed positions and are spaced apart when the tooling assemblies are in their open positions, strip feeding means for feeding the strip material along a strip feed path which extends transversely of the tooling assembly path and between the leading ends of the tooling assemblies whereby operations are performed on the strip material when the tooling assemblies move to their closed positions, the apparatus having pilot pin means which are movable with, and extend parallel to, the first tooling assembly, the pilot pin means having free end portions which enter pilot holes in the strip material prior to arrival of the first tooling assembly at its closed position thereby precisely to position the strip material between the tooling assemblies prior to engagement of the tooling assemblies with the strip material, the apparatus being characterized in that:

the pilot pin means is movable, relative to the first tooling assembly, parallel to the tooling assembly path of reciprocation between a retracted position and an extended position, the free end portions of the pilot pin means being proximate to the leading end of the first tooling assembly when the pilot pin means is in its retracted positions and being located forwardly of, and beyond, the leading end of the first tooling assembly when the pilot pin means is in its extended positions, and pilot pin actuating means are provided for moving the pilot pin means from its retracted position to its extended position during movement of the first tooling assembly from its open position to its closed position, and for moving the pilot pin means from its extended position to its retracted position during movement of the first tooling assembly from its closed position to its open position whereby, when the first and second tooling assemblies are in their open positions, the space between the leading ends of the first and second tooling assemblies is not obstructed by the face end portions of the pilot pin means.

2. Apparatus as set forth in claim 1 characterized in that the pilot pin actuating means comprises at least one lever means which is pivotally mounted intermediate its ends on an intermediate pivot, the lever means having one end which is pivoted to the pin means, the other end of the lever means being pivotally connected to means for causing oscillation of the lever means about the intermediate pivot in synchronism with reciprocation of the tooling assembly thereby to cause movement of the pilot pin means between its retracted position and its extended position in synchronism with movement of the first tooling assembly between its open position and its closed position.

3. Apparatus as set forth in claim 2 characterized in that the first tooling assembly comprises a reciprocable ram, the intermediate pivot of the lever means being on the ram.

4. Apparatus as set forth in claim 3 characterized in that static guide means are provided for guiding the ram along the tooling assembly path of reciprocation, the other end of the lever means being pivotally connected to the static guide means whereby, movement of the ram along the tooling assembly path of reciprocation results in movement of the intermediate pivot along the path of reciprocation and the lever means is thereby oscillated.

5. Apparatus as set forth in claim 1 characterized in that the pilot pin means has inner end portions which are carried by the first tool assembly whereby the pilot pin means is moved with the first tooling assembly by the first tooling assembly actuating means, and is moved relative to the first tooling assembly by the pilot pin actuating means.

6. Apparatus as set forth in claim 5 characterized in that the pilot pin actuating means comprises motion transmitting means for transmitting motion from the first tooling assembly to the pilot pin means.

7. Apparatus as set forth in claim 1 characterized in that the pilot pin means is slidably mounted on the first tooling assembly whereby the pilot pin means is moved with the first tooling assembly by the tooling assembly actuating means when the first tooling assembly moves between its open and closed positions, and the pilot pin means is moved relative to the first tooling assembly by the pilot pin actuating means, the pilot pin actuating means comprising means for transmitting motion from the first tooling assembly to the pilot pin means.

8. Apparatus as set forth in claim 7 characterized in that static guide means are provided for guiding the first tooling assembly along the tooling assembly path of reciprocation, the pilot pin actuating means comprising at least one lever which is pivotally mounted intermediate its ends on the first tooling assembly, the lever having one end which is pivoted to the pilot pin means, the other end of the lever being pivoted to the guide means.

9. Apparatus for performing stamping and forming operations on strip material, the apparatus comprising first and second tooling assemblies which are movable towards and away from each other between open and closed positions along a tooling assembly path of reciprocation, tooling assembly actuating means for moving the tooling assemblies between their open and closed positions, the tooling assemblies having leading ends which are proximate to each other when the tooling assemblies are in their closed positions and are spaced apart when the tooling assemblies are in their open positions, strip feeding means for feeding the strip material along a strip feed path which extends transversely of the tooling assembly path and between the leading ends of the tooling assemblies whereby operations are performed on the strip material when the tooling assemblies move to their closed positions, the apparatus having pilot pins which are movable with, and extend parallel to, the first tooling assembly, the pilot pins having free ends which enter pilot holes in the strip material prior to arrival of the first tooling assembly at its closed position thereby precisely to position the strip material between the tooling assemblies prior to engagement of the tooling assemblies with the strip material, the apparatus being characterized in that:

the pilot pins are carried by, and are moved with, the first tooling assembly when the first tooling assembly moves between its open and closed position, the pilot pins are movable, relative to the first tooling assembly, parallel to the tooling assembly path of reciprocation between retracted positions and extended positions, the free ends of the pilot pins being proximate to the leading end of the first tooling assembly when the pilot pins are in their retracted positions and being located forwardly of, and beyond, the leading end of the first tooling assembly when the pilot pins are in their extended positions, and pilot pin actuating means are provided for moving the pilot pins from their retracted positions to their extended positions during movement of the first tooling assembly from its open position to its closed position, and for moving the pilot pins from their extended positions to their retracted positions during movement of the first tooling assembly from its closed position to its open position whereby, when the first and second tooling assemblies are in their open positions, the space between the leading ends of the first and second tooling assemblies is not obstructed by the pilot pins.

10. Apparatus as set forth in claim 9 characterized in that the pilot pin actuating means comprises motion transmitting means for transmitting motion from the first tooling assembly to the pilot pins.

11. Apparatus as set forth in claim 10 characterized in that static guide means are provided for guiding the first tooling assembly along the tooling assembly path of reciprocation, the pilot pin actuating means comprising at least one lever which is pivotally mounted intermediate its ends on the first tooling assembly, the lever having one end which is pivotally connected to the pilot pins, the other end of the lever being pivotally connected to the guide means.

12. Apparatus as set forth in claim 11 characterized in that the other end of the lever is pivotally connected to the guide means by a normally fixed pivotal axis which is movable upon imposition of a predetermined force thereon thereby to prevent damage to the apparatus in the event of jamming of the pilot pins.

13. Apparatus as set forth in claim 11 characterized in that the static guide means has a pivot support member thereon, the other end of the lever being pivotally connected to the pivot support member, the pivot support member being yieldingly mounted on the static guide means and being movable relative thereto upon imposition of a predetermined force on the pivot support whereby, damage to the apparatus is prevented in the event of jamming of the pilot pins.

14. Apparatus as set forth in claim 10 characterized in that the first tooling assembly has a recess therein and a slidable yoke assembly in the recess, the pilot pins having inner ends which are secured to the yoke assembly.

15. Apparatus as set forth in claim 14 characterized in that static guide means are provided for the first tooling assembly, the pilot pin actuating means comprising a pair of spaced apart levers, each of the levers being pivotally mounted intermediate its ends by an intermediate pivot on the first tooling assembly, each lever having one end which is pivotally connected to the yoke assembly, the other end of each lever being pivotally connected to the static guide means whereby, movement of the first tooling assembly along the tooling assembly path of reciprocation causes oscillation of the levers and movement of the yoke assembly relative to the first tooling assembly.

16. Apparatus as set forth in claim 15 characterized in that the yoke assembly comprises a yoke slide and spaced apart guide rails which are secured to the slide and which extend rearwardly of the first tooling assembly from the leading end thereof, the pilot pins being secured to the yoke slide, the one end of each lever being pivotally connected to one of the guide rails.

* * * * *